United States Patent [19]

Barth et al.

[11] Patent Number: 4,834,575

[45] Date of Patent: May 30, 1989

[54] PAVING STONE

[76] Inventors: Günther Barth, Butzengrabenweg 16, D-7551 Bühlertal; Fritz V. Langsdorf, Blumenstrasse 12, D-7551 Förch, both of Fed. Rep. of Germany

[21] Appl. No.: 29,007

[22] Filed: Mar. 23, 1987

[30] Foreign Application Priority Data

Sep. 23, 1986 [AT] Austria ..... 540863-870

[51] Int. Cl.[4] ..... E01C 5/06

[52] U.S. Cl. ..... 404/39; 404/41

[58] Field of Search ..... 404/34, 37, 38, 39, 404/41, 42; 405/20; 52/590, 603, 604, 608

[56] References Cited

U.S. PATENT DOCUMENTS

| | | | |
|---|---|---|---|
| 1,058,674 | 4/1913 | Kertes | 404/38 X |
| 2,662,343 | 12/1953 | Rice | 404/34 X |
| 3,597,928 | 8/1971 | Pilaar | 405/20 |
| 4,128,357 | 12/1978 | Barth et al. | 404/41 |
| 4,185,939 | 1/1980 | Barth et al. | 404/38 |

FOREIGN PATENT DOCUMENTS

| | | | |
|---|---|---|---|
| 7821651 | 2/1979 | Fed. Rep. of Germany . | |
| 3303225 | 8/1984 | Fed. Rep. of Germany . | |
| 346056 | 4/1931 | United Kingdom | 404/34 |
| 004557 | 5/1985 | World Int. Prop. O. . | |

*Primary Examiner*—Jerome W. Massie
*Assistant Examiner*—Matthew Smith
*Attorney, Agent, or Firm*—Spencer & Frank

[57] ABSTRACT

A paving stone for use with other similarly configured paving stones all of which are to be laid adjacent each other to form a paved surface. The paving stone having two centrally symmetrical contiguous parts at least one of which is generally square-shaped and has cut-off corners. The parts being joined along a side that is common to the two parts. There being, along the common side, a dummy groove that is common to the two parts and gives the appearance of separateness between the two parts. The one part also has at each of the four cut-off corners of the square, a protrusion which extends along the continuation of a line which joins the corner with the diametrically opposite corner. Each protrusion being directed toward a protrusion of an adjacent paving stone when the paving stone is part of a paved surface formed by a plurality of paving stones. The length of each protrusion being such that there is left, between the end of the protrusion and the end of the protrusion toward which it is directed, a substantial free space through which water may flow downwardly from the paved surface.

6 Claims, 2 Drawing Sheets

PAVING STONE

BACKGROUND OF THE INVENTION

The present invention relates to a paving stone or ground covering stone of the type in which free spaces of considerable size for discharging water are left between mutually identical paving stones that are laid beside each other on a ground. The paving stone consists preferably of concrete.

In the past few years one could note a tendency towards the increasing use of paving stones for paving areas, such as pedestrian areas, yards, squares, garage drives, footpaths, factory yards, port installations etc. The ground areas paved with paving stones laid thereon, which are in particular artificial paving stones of concrete, present a clean, neat and optically pleasing appearance and are well suited for being driven on by vehicles and for being used by pedestrians. However, the increasing use of paving stones entails a certain occlusion of the ground with respect to rainwater. Rain is then discharged into the ground only to a small degree through the gaps between adjacent paving stones, whereas most of the rainwater flows off over the paved area and is discharged into a drainage system. Consequently, this extensive occlusion of areas leads to an increased amount of water for the drainage system and sewage plants and moreover to increased lowering of the groundwater level as compared with the condition without stone pavement. However, it is generally desired not to have the groundwater level drop excessively, in particular in order to maintain the important humidity reservoir of the groundwater for the roots of trees and for rendering the winning of drinking water from groundwater easier.

For mitigating the above-mentioned disadvantageous consequences of paving areas with paving stones, it has already been conceived to provide water discharge spaces between adjacent paving stones, so that more water flows into the ground and is not discharged into the drainage system. A first known approach for achieving this consists in the provision of local spacing projections so that relatively wide downwardly opening gaps result between adjacent paving stones. A typical example of this prior art is German-"Offenlegungsschrift" No. 33 03 225. A second approach for providing ground pavements of paving stones that permit the passage of more water consists in providing, at specific locations of the outline of the particular paving stone, a recess that is not filled when placing a neighboring paving stone adjacent thereto, so that local free spaces for discharging precipitation result in the finished pavement. A typical example of this prior art is German Utility Model No. 78 21 651.

Furthermore, U.S. Pat. No. 4,128,357 to Barth et al shows a paving stone in which a first part, having the configuration of a centrally symmetrical octagon, and a second part, having the configuration of a square with four protrusions projecting outwardly at the corners at an angle of 45°, are integrally joined together and are optically separated from one another by a dummy gap or dummy groove. When laying a plurality of these known paving stones beside each other, the paved area is occluded completely except for the relatively narrow gaps between the paving stones. Thus, free spaces for the discharge of water into the ground are not provided.

SUMMARY OF THE INVENTION

It is the object of the invention to provide a paving stone with which, in the laid condition, free spaces of considerable size are provided in relation to its neighboring stones for the discharge of water into the ground.

A further object of the invention is to provide a paving stone that can be laid in a multiplicity of laying patterns with identical neighboring stones and which, also irrespective of the laying pattern, results in the desired water discharging spaces, without the laying pattern being recognizable in the laid state.

It is an additional object of the invention to provide the free spaces between the stones by such a design of the paving stones that the forces transmitted between adjacent stones due to an interengagement effect are taken up in an advantageous manner.

According to the invention is a paving stone of the type in which free spaces of considerable size for discharging water are left between mutually identical paving stones that are laid beside each other on the ground is provided. The paving stone according to the invention includes the following features:

(a) the paving stone consists of a centrally symmetrical first part and a centrally symmetrical second part which are integrally connected and are optically separated from one another by a dummy gap or dummy groove;

(b) the outline of the first part of the paving stone displays three identical outline sections which are set together at right angles relative to each other; the dummy gap extends substantially in the manner of a mirror image with respect to the middle one of the three outline sections when this section is seen shortened on both ends; and between the dummy gap and the first outline section as well as the third outline section there is provided one intermediate outline section each;

(c) the outline of the second part of the paving stone displays three identical outline sections which are set together at right angles each; the said dummy gap extends substantially in the manner of a mirror image with respect to the middle one of the three outline sections when this section is seen shortened on both ends; and between the dummy gap and the first outline section as well as the third outline section there is provided one intermediate outline section each;

(d) the three outline sections of the first part of the paving stone and the three outline sections of the second part of the paving stone are of such configuration that, when laying the paving stone, an arbitrary one of the three outline sections, except for its end portions, of the first part of a paving stone fits together with an arbitrary one of the three outline sections, except for its end portions, of the second part of an adjacent paving stone;

(e) the second part of the paving stone has a configuration with four protrusions disposed at a mutual angular spacing of substantially 90°, and the protrusions, as seen in the radial direction, are only of such length that in the laid condition the free spaces are left between the ends of the protrusions of adjacent paving stones.

It is especially preferred when the paving stone has a first part which has the shape of a centrally symmetrical octagon with alternating longer and shorter sides, and a second part which also has the shape of a centrally symmetrical octagon with alternating longer and shorter sides but which has four protrusions protruding at the shorter sides thereof, with the protrusions, as seen radially or in the direction of their length, being so short that the afore-mentioned free spaces remain between the ends of the protrusions of adjacent paving stones. The free spaces are preferably of square or rectangular configuration. Furthermore, it is preferred to chamfer the upper sides of the protrusions completely or partly in such a manner that their height decreases as seen in radial outward direction. This improves the water discharge into the free spaces and, furthermore, provides the possibility of selecting the optical impression of the free spaces to be greater or smaller by filling the free spaces with a water permeable filling material, such as fine grained gravel, to a higher or less high extent.

The stone of U.S. Pat. No. 4,128,357, discloses the protrusions at the four corners of the second part of the paving stone were understood as advantageous locations for establishing a good interengagement effect between adjacent paving stones. Contrary thereto, the stones according to the invention attach more significance to the aspect that shorter protrusions reduce the loads which, due to the interengagement effect between adjacent paving stones, act upon the transition region between the particular protrusion and the remaining second part of the paving stone. As a consequence hereof, the paving stone according to the invention represents an optimum combination between the provision of free spaces for discharging water and the interengagement effect between adjacent paving stones, while reducing the risk of breakage at the root of the particular protrusion. The protrusions are provided at optimum locations in which the free spaces can be provided simply by shortening the protrusions.

DESCRIPTION OF THE PREFERRED EMBODIMENT

Figure 1:
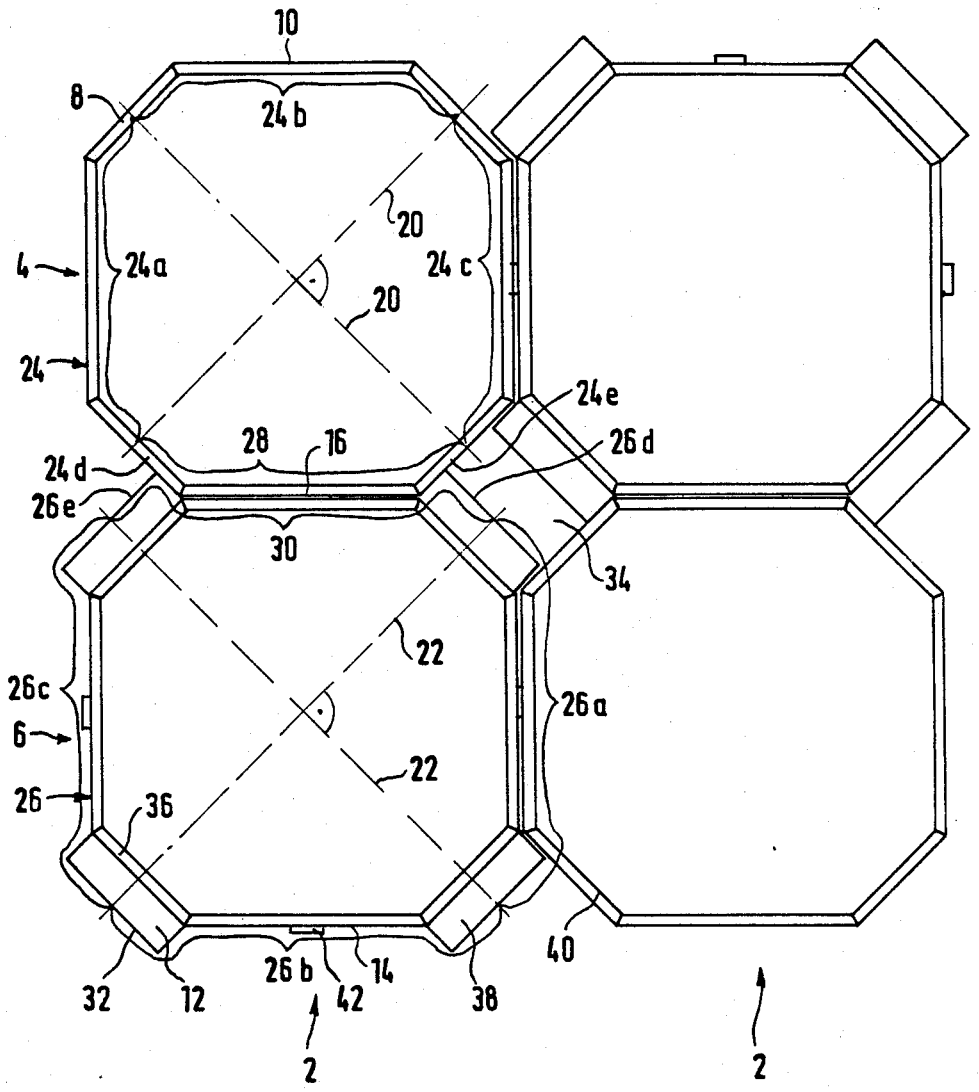
FIG. 1 shows a top view of two paving stones according to the invention that are laid beside one another.

FIG. 1 displays two identical paving or ground covering stones of concrete which hereinafter are briefly referred to as "stones" 2 and which are laid one beside the other. For reasons of simplicity, only the left one of these two stones 2 will be described hereinafter.

The stone 2 consists of a first part 4 shown at the upper side in FIG. 1 and of a second part 6 shown at the lower side in FIG. 1. The first part 4 has the configuration of a centrally symmetrical octagon in which the four oblique side sections 8 are considerably shorter than the remaining four side sections 10 therebetween, thus forming an octagon with alternating long side sections 10 and short side sections 8. The second part 6 has the same configuration as the first part 4, but is formed with four protrusions 12 adjacent the short side sections 8. The protrusions 12 protrude outwardly from the octagonal basic form between the long side sections 14, with the longitudinal extension of said protrusions 12 having an angle of 45° relative to said long side sections 14. The first part 4 and the second part 6 are integrally connected to one another and are optically separated from one another by a dummy gap or dummy groove 16. The dummy gap 16 is a kind of channel or groove between the first part 4 and the second part 6, which extends downwardly from the upper face 18 of the stone 2, in the laid state, to a specific depth only.

FIG. 1 further shows two lines diagonal 20 extending at right angles with respect to each other from the center of the first part 4 to the oblique side sections 8. Analogously thereto, two diagonal lines 22 are shown in the second part 6 which extend at right angles with respect to each other from the center to the ends of the protrusions 12. The intersection of the lines 20 with the outline 24 of the first part 4 defines three outline sections 24*a*, 24*b* and 24*c*. These three outline sections are identical with each other. The second or middle outline section 24*b* is formed by attaching to the right end of the first outline section 24*a* an identical outline section, which is rotated by 90°, with its left end. The same applies to the third outline section 24*c*. In case of the second part 6, the outline 26 also comprises three mutually identical outline sections 26*a*, 26*b* and 26*c* which are set together in the same corresponding manner as in case of the first part 4. It can be seen that adjacent outline sections 24*a*, 24*b*, 24*c* merge with each other at their respective end portions in aligned manner at oblique side sections 8, and that adjacent outline sections 26*a*, 26*b*, and 26*c* merge with each other at their respective end portions in aligned manner at the face sides of protrusions 12. The outline sections 24*a*, 24*b*, and 24*c* each consist of three straight section parts that are set together in an angular manner; the outline sections 26*a*, 26*b*, and 26*c* each consist of five straight section parts that are also set together in an angular manner.

The fourth side of the first part 4 is shown by outline 28 radially opposite outline section 24*b* and extending in the manner of outline section 24*a* or 24*b*, 24*c*. The fourth side of the second part 6 is shown by outline 30 radially opposite outline section 26*b* extending in the manner of outline section 26*a*, or 26*b* or 26*c*. Fourth outlines sections 28 and 30 at both each include, a central portion generally coextensive with the dummy gap 16 which is common to the first part 4 and the second part 6 and whose length of extension corresponds to a long side section of the octagon. Thus, the first part 4 is confined at its fourth side by the dummy gap 16 and an end portion 24*d* extending between the dummy gap 16 and the first outline section 24*a*, as well as by an end portion 24*e* extending between the dummy gap 16 and the third outline section 24*c*. The second part 6 is also confined at its fourth side by the dummy gap 16, an angled end portion 26*d* extending between the dummy gap 16 and the first outline section 26*a*, as well as by an angled end portion 26*e* extending between the dummy gap 16 and the third outline section 26*c*. The end portion 24*d* merges with the first outline section 24*a* in aligned manner, and the end portion 24*e* merges with the third outline section 24*c* in aligned manner. Likewise, the end portion 26*d* merges with the first outline 26*a* in aligned manner, and the end portion 26*e* merges with the third outline section 26*c* in aligned manner.

Furthermore, it can be seen from FIG. 1, that any arbitrary outline section 24*a*, 24*b* or 24*c* of the first part 4 fits together with any arbitrary outline section 26*a*, 26*b* and 26*c* of the second part 6, when the respective end portions of the outline sections are left out of consideration. FIG. 1 depicts a laying pattern in which the right-hand stone 2 is placed against the left-hand stone 2 in opposite orientation, i.e. rotated in its plane by 180°. Instead of this, it is possible in particular to fit the right-hand stone 2 with the middle outline section **24*b* of the first part 4 thereof into one of the three outline sections 26*a*, 26*b* or 26*c* of the second part 6**, so that the stones are placed together in a manner rotated by 90° or in an aligned adjoining manner.

FIG. 1 further shows, that between the outwardly facing face ends 32 of the protrusions 12 of adjacent stones 2 there is formed one substantial free space 34 each, having a rectangular or square configuration and serving for discharging water between the stones 2 into the ground. Due to the overall configuration of the stones 2, these free spaces 34 are uniformly distributed over the entire pavement area and are of a considerable size in comparison with the elongate narrow gaps between adjacent stones 2, so that larger quantities of water are discharged through the pavement into the ground. The protrusions 12 are of shorter length in comparison with the prior art, so that the loads are reduced which act on the protrusions 12, especially at the root 36 thereof at the junction of the protrusions 12 and the body of the second part 6, due to the interengagement of adjacent stones 2. This reduction being due to the fact that, so to speak, the lever arm of these loads has become smaller.

Figure 2:
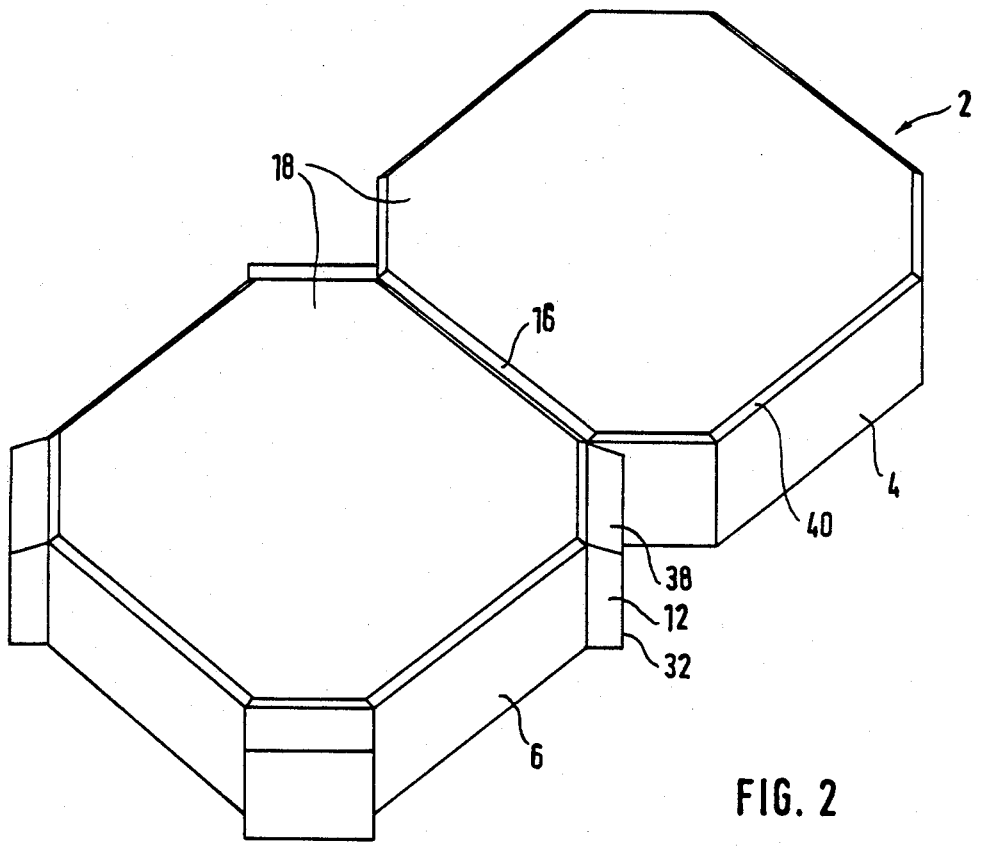
FIG. 2 shows a perspective view of one paving stone according to the invention as shown in FIG. 1.

FIG. 2 gives a three-dimensional impression of the stone 2 according to the invention. It shows in particular the upper roof-like chamber 38 of the protrusions 12 as well as bevels 40 at the outline of the stones 2 and at the transition to the dummy gap 16.

When the chamfer 38 at the protrusions 12 starts further outwardly or when the dummy gap 16 is relatively deep, the dummy gap 16 extends on each of its left-hand and right-hand sides to a greater extent into the region between the short side section 8 of the first part 4 and the protrusion 12, so that the dummy gap 16 resembles more strongly an outline section **24*a*, 24*b*, 24*c* in its configuration, while, however, being shortened on both ends with respect to the outline section. In any case the dummy gap 16 is substantially a mirror image of the middle outline section 24*b* or of the middle outline section 26*b*, when the respective outline section 24*b*, 26*b*** is seen shortened on both ends.

In particular when the protrusions 12 are not chamfered at the top, it is possible to provide short dummy gaps at the transition of the protrusions 12 into the remaining second part 6, so as to optically set off the protrusions 12.

Furthermore, it is possible to provide spacing projections 42 as they are shown in FIG. 1 only, which are located approximately in the middle of the outline sections **26*a*, 26*b*, 26*c* of the second part 6 each, and/or to provide the outline sections 24*a*, 24*b*, 24*c*, 26*a*, 26*b*, 26*c* additionally with a wave-like or serrated pattern, thereby improving the interengagement of adjacent stones 2. This is a reason why it has been stated hereinbefore that the dummy gap 16** is "substantially a mirror image" of the shortened, opposed outline section.

After the stones 2 are laid, the free spaces 34 are filled up with a suitable material, in particular sand, to a desired height.

We claim:

1. A generally planar paving stone for use with other similarly configured paving stones, which paving stones are to be laid adjacent each other to form a paved surface, each paving stone having two octagonal parts integrally joined at a juncture comprising a dummy groove that is common to the two parts and gives the appearance of separateness between the two parts, one of the two parts having two protrusions arranged, respectively, on the two sides adjacent the dummy groove and two additional protrusions arranged, respectively, diagonally opposite the two first-mentioned protrusions; each protrusion, when two paving stones are laid in abutting relationship next to each other such that the one part of one of the two paving stones is next to the other part of the other of the two paving stones, projecting toward a protrusion of such other paving stone and each protrusion extending less than half of the length of the distance between the side from which the protrusion projects to the side of the other paving stone from the facing protrusion projects, so that there is left, between two facing protrusions, a substantial free space through which water may flow downwardly from the paved surface.

2. A paving stone as defined in claim 1, wherein the four sides of the octagon from which the respective protrusions project are shorter than the remaining four sides.

3. A paving stone as defined in claim 1, wherein the free space is of rectangular configuration.

4. A paving stone as defined in claim 1, wherein said protrusions are chamfered at their upper side throughout at least a part of their radial length in such a manner that the height of each protrusion decreases outwardly.

5. A paving stone as defined in claim 4, wherein the four sides of he octagon from which the respective protrusions project are shorter than the remaining four sides.

6. A paving stone as defined in claim 4, wherein the free space is of rectangular configuration.

* * * * *

UNITED STATES PATENT AND TRADEMARK OFFICE

CERTIFICATE OF CORRECTION

PATENT NO. : 4,834,575

DATED : May 30th, 1989

INVENTOR(S) : Günther Barth and Fritz Von Langsdorf

It is certified that error appears in the above-identified patent and that said Letters Patent is hereby corrected as shown below:

In the heading of the patent, [76] Inventors: the zip code for the first Inventor should be --D-7582-- instead of "D-7551". The second Inventor's last name should be --Von Langsdorf-- instead of "V. Langsdorf".

Signed and Sealed this

Twenty-seventh Day of February, 1990

*Attest:*

JEFFREY M. SAMUELS

*Attesting Officer* *Acting Commissioner of Patents and Trademarks*